United States Patent [19]

Sandos

[11] 4,209,048

[45] Jun. 24, 1980

[54] FLOATABLE FABRIC WALLET

[75] Inventor: Michael S. Sandos, Salt Lake City, Utah

[73] Assignee: Bear Body, Inc., Salt Lake City, Utah

[21] Appl. No.: 876,212

[22] Filed: Feb. 9, 1978

[51] Int. Cl.[2] ..... A45C 1/06

[52] U.S. Cl. ..... 150/38; 150/39; 150/46

[58] Field of Search ..... 150/35, 38, 42, 46, 150/39; D87/3 A

[56] References Cited

U.S. PATENT DOCUMENTS

| | | | |
|---|---|---|---|
| D. 141,414 | 5/1945 | Shallman | D87/3 A |
| 781,948 | 2/1905 | Hegele | D87/3 A |
| 1,310,527 | 7/1919 | Guinzburg | 150/42 X |
| 1,310,621 | 7/1919 | Holland | 150/39 |
| 1,787,054 | 12/1930 | Schener | 150/35 |
| 1,924,702 | 8/1933 | Wege | 150/38 |
| 2,439,731 | 4/1948 | Howes | 150/39 |
| 2,606,588 | 8/1952 | Kaufman | 150/28 R |
| 2,623,566 | 12/1952 | Kibler | 150/28 R |
| 2,784,757 | 3/1957 | Bosca | 150/38 |
| 2,789,614 | 4/1957 | Broughton | 150/42 |
| 3,161,216 | 12/1964 | Sloves | 150/38 X |
| 3,392,771 | 7/1968 | Hartley | D87/3 A |
| 3,659,640 | 5/1972 | Fenster | 150/35 |
| 3,946,781 | 3/1976 | Reis | 150/35 |
| 4,008,742 | 2/1977 | Lehler | 150/35 |

FOREIGN PATENT DOCUMENTS

| | | | |
|---|---|---|---|
| 1293814 | 4/1962 | France | 150/42 |

OTHER PUBLICATIONS

Beckers (Gift Catalogue), Nov. 7, 1976, p. 18, 1314 F. Street, N. W., Washington, D.C.

W. Bell & Co., (Gift Catalogue), 1975, pp. 191 & 192.

Best Products (Buvers Book), 1976, pp. 205, 206 & 207.

St. Thomas (Wallets), 1967 Publication, Gloversville, N.Y.

*Primary Examiner*—Allan N. Shoap

*Attorney, Agent, or Firm*—Trask & Britt

[57] ABSTRACT

A currency pocket for a wallet is formed from an inner piece and a multi-layered back piece. The back piece is comprised of an inner fabric liner, an outer fabric layer and a material insert therebetween. The inner piece is sized and secured to the back piece to form a transverse flap to which a velcro strip is secured. A corresponding velcro strip is secured transversely along the opposite transverse edge of the outer fabric layer. The finished wallet readily conforms to body contours, and when closed, tends to float.

10 Claims, 1 Drawing Figure

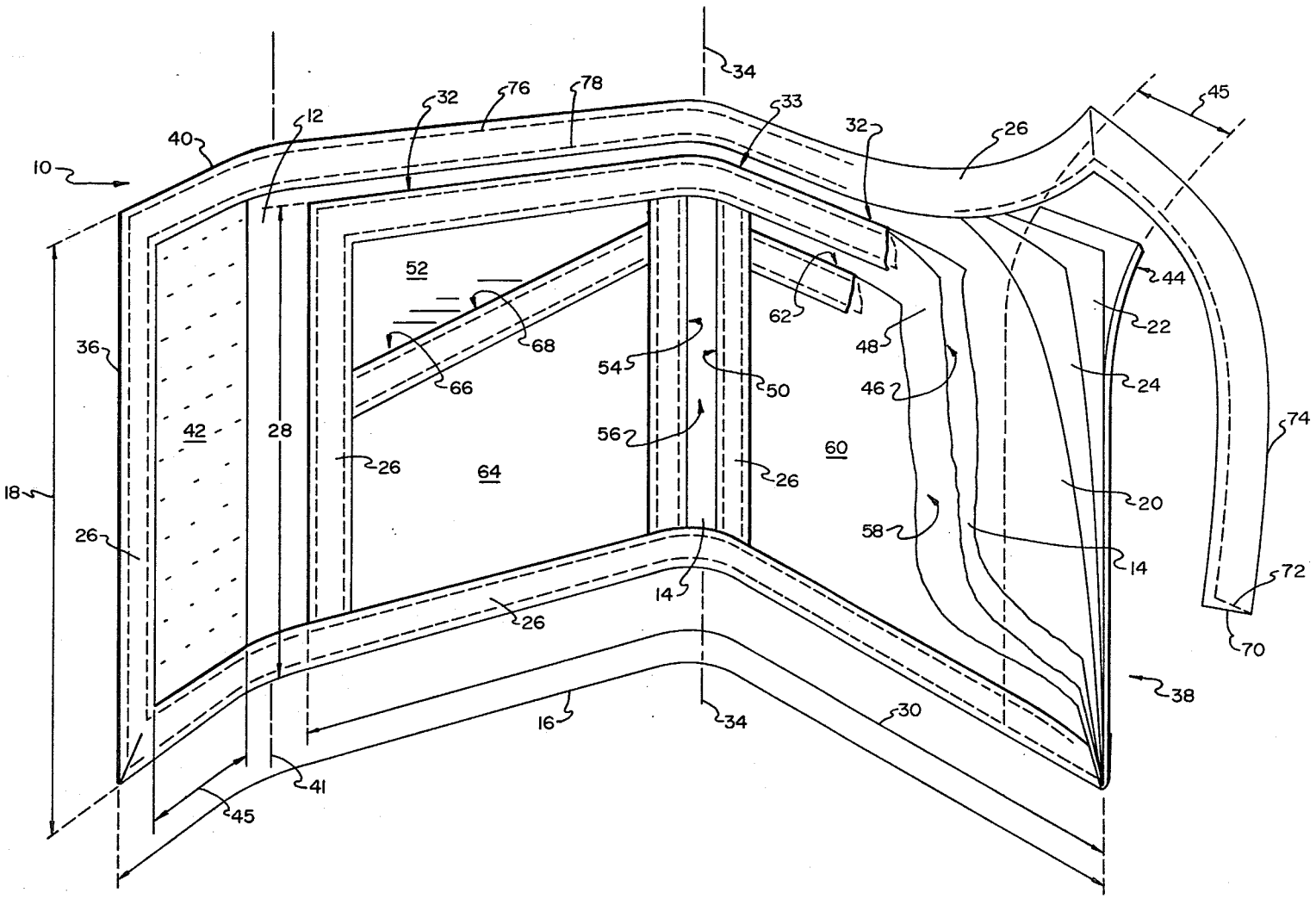
74
72
70
45
44
22
24
20
14
38
26
32
48
46
58
30
60
62
33
50
26
34
34
14
54
56
78
68
16
76
26
64
66
32
52
26
12
28
41
45
42
40
36
26
10
18

FLOATABLE FABRIC WALLET

BACKGROUND OF THE INVENTION

1. Field

This invention relates to pocket-sized accessories. More particularly, this invention provides for a floatable fabric wallet.

2. State of the Art

Wallets to carry or contain paper currency, coins, credit cards, photographs, identification cards and the like are well known. Such wallets are typically sized to fit within trouser pockets, inside jacket pockets and the like. Wallets heretofore known are frequently made of leather or leather-like materials to be both aesthetically pleasing in appearance and functional in the sense that they will sustain substantial wear in use.

Wallets heretofore known typically sink if accidentally dropped into water. Leather wallets or wallets made of comparable materials restrict air circulation in the vicinity of the pocket into which they are placed. This characteristic, together with the inability of most wallets to yield in conformance with body contours, cause some discomfort to the user. Such wallets may also be regarded as somewhat heavy for hikers and back packers. In sporting activities, and particularly outdoor sports, a wallet may be regarded as an unnecessary impediment or encumbrance. However, in many circumstances, it is desirable to have identification, money and other items, including credit cards, on the person. Accordingly, in practice a wallet is almost always carried. Conventional wallets are limited in the color stylings available, and are thus an annoyance to style-concious individuals.

SUMMARY OF THE INVENTION

A wallet according to this invention has a back piece which is substantially rectilinear in shape. The back piece has an inner fabric liner, an outer fabric layer and a material insert between the inner liner and the outer layer. The inner liner and outer layer are sized substantially the same and are secured to each other about the edges thereof. A fabric inner piece is secured to the back piece to form a currency pocket sized in width and length to receive paper currency. The back piece and inner piece are foldable about a major axis approximate the lengthwise midpoint of the inner piece. Latching means are secured to the back piece along opposite transverse edges thereof to coact to latch the opposite transverse edges together when the back piece is folded into two halves about the major axis.

The inner piece, inner liner and outer layer are preferably made of a liquid-resistant material. The insert is preferably made of a substantially non-absorptive material resistive to the migration of liquid therethrough. The outer fabric layer and the fabric inner piece are more preferably made of a duck-like material. The insert is more preferably made of a crinoline material. Most preferably, the inner fabric liner is made of a nylon-like taffeta material. The material insert is most preferably a heavy weight interlon material. The outer fabric liner and the inner piece are most preferably a nylon duck material.

In another embodiment, the inner piece is sized in length less than the length of the back piece and secured thereto to form a flap foldable about a minor axis around the adjoining transverse edge of the inner piece. The latching means is preferably a coacting pair of velcro strips, one being a threaded surface and one being a hook surface. One velcro strip is secured on the inner piece side of the back piece and one is secured to the outer fabric layer along the transverse edge opposite the transverse edge of the flap. The hook surface is preferably secured to the flap and the threaded surface is preferably secured to the outer layer. The wallet is folded about the axis and the flap is folded so that the velcro strips may be pressed together to latch the wallet together.

In another embodiment, first and second pocket pieces each sized in width substantially the width of the inner piece and in length less than one-half the length of the inner piece are secured to the inner piece. The pocket pieces are each substantially rectilinear in shape and secured to the inner piece along three edges thereof to form pockets with a mouth facing the major axis. Third and fourth pocket pieces, each sized in length substantially the length of the first and second pocket pieces, respectively, and in width less than the width of the first and second pocket pieces, are secured thereto. The third and fourth pocket pieces are shaped to have three edges substantially coterminous with the edges of the first and second pocket pieces, respectively, to form pockets having lengthwise mouths. The edges of the wallet may be secured with a binding material.

BRIEF DESCRIPTION OF THE DRAWINGS

The drawing illustrates the best mode presently contemplated for carrying out the invention and is a perspective inside view with a cut-away portion of a floatable fabric wallet of the instant invention.

DESCRIPTION OF THE ILLUSTRATED EMBODIMENT

The illustrated wallet is generally indicated by the numeral 10. It has a back piece generally indicated by the numeral 12 and an inner piece generally indicated by the numeral 14. The back piece 12 is substantially rectilinear in shape. It is sized in length 16 and in width 18 greater than the length and the width of paper currency, such as U.S. Federal Reserve Bank Notes.

The back piece 12 has an inner fabric liner 20, an outer fabric layer 22 and a material insert 24. The outer layer 22 and inner liner 20 are sized substantially the same and are secured to each other about the edges thereof by hemming or more preferably, as here shown, by a binding material 26. Preferably, the material insert is sized comparably to the inner liner 20 and outer layer 22 and is similarly secured by the binding material 26 along its outside edges.

The fabric inner piece 14 is also formed to be substantially rectilinear in shape. It is sized in width 28 and length 30 no greater than the width 18 and length 16 of the back piece 12. It is sized greater than the length and width of paper currency. The inner piece 14 is secured along its edges to the back piece 12 to form a currency pocket 32 between the inside of the inner liner 20 and the inside of the inner piece 14. The currency pocket 32 has a lengthwise opening or mouth 33 and is sized in length. The wallet 10 is foldable about a major axis 34 which is approximate the longitudinal or lengthwise midpoint of the inner piece 14. Latching means are secured to the back piece 12 along opposite transverse edges 36 and 38 to coact to latch the opposite transverse edges 36 and 38 together when the back piece 12 is folded into two adjacent halves about the major axis 34.

As here shown, the inner piece 14 is sized in length 30 less than the length 16 of the back piece 12. The inner piece 14 is secured to the back piece 12 to form a flap portion 40 which is foldable about the minor axis 41. The latching means is preferably a pair of coacting velcro strips. One strip is a hooked strip or hook surfaced strip 42; and the other is a threaded surface strip 44. The hooked surface strip 42 is secured to the inside or inner liner side to extend transversely approximately the width 18 of the back piece 12. The threaded surface strip 44 is secured along the opposite transverse edge 38 of the back piece 12 on the outside or to the outer layer 22 of the back piece 12. The strips 42 and 44 are preferably of substantially the same width 45 which is about one inch. The velcro may be standard 4000 velcro.

The wallet 10 may also have additional pockets provided to retain credit cards, driver's license, notes, business cards, pictures and the like. A first pocket 46 may be formed by securing a pocket piece 48 to the inner piece 14. The first pocket piece 48 is substantially rectilinear in shape and sized in width 28 approximately the width of the inner piece 14. It is sized in length approximately half the length 30 of the inner piece 14 to form a pocket sized to receive conventional credit cards and the like. The first pocket piece 48 is secured to the inner piece 14 along three edges thereof to form a mouth 50 substantially parallel the major axis 34. A second pocket piece 52 is substantially symmetrical to the first pocket piece 48 and may be secured over the other half of the inner piece 14 to form a second pocket 54 having a mouth 56 along the major axis 34. A third pocket 58 may be provided by securing a third pocket piece 60 to the first pocket piece 48. The third pocket piece 60 is preferably rectilinear in shape and sized in width less than the width of the first pocket piece 48, as shown. It may be sized in length comparable or substantially the same as the length of the first pocket piece 48. The third pocket piece 60 is secured to the first pocket piece 48 and to the inner piece 14 along three edges thereof to form a longitudinally oriented mouth 62. A fourth pocket piece 64 may be positioned over the second pocket piece 52 similar to the third pocket piece 60 being mounted to the first pocket piece 48. The fourth pocket piece 64 has a diagonal mouth 66 so that cards or other materials positioned within the fourth pocket 68 are more readily visible. A plurality of small pockets, coin purses or the like may be secured to the inner piece or to the outer layer of the wallet as desired to comport with esthetic or practical features preferred by the user.

The outer fabric layer 22 and the inner piece 14 are both made of a duck-like material and preferably of a nylon duck material. Such material may be regarded as being liquid-resistant or water-repellent. Nylon duck material is preferred because it is resistive to water while at the same time providing for air circulation. Accordingly, when the wallet 10 if folded and positioned in a pocket on the person of the user, it tends to be less uncomfortable, both because air more readily circulates and because the wallet 10 is sufficiently pliable to conform to the body contours of the user. 7.25 ounce nylon duck material is satisfactory for use because it has good wear characteristics while being lightweight. The inner liner 14 and the pocket pieces 48, 52, 60 and 64 are also desirably of nylon duck material to resist water.

The insert material 24 is preferably made of a crinoline substance and is most preferably a heavy weight interlon material. This material does not absorb liquids and resists the migration of liquid therethrough.

The inner liner 20 is preferably made of a nylon-like material and most preferably of a nylon taffeta material. Suitable nylon taffeta is 2.2 ounce. The nylon taffeta 24 is selected to provide a smooth slippery surface to facilitate the insertion and removal of paper currency and also to be lightweight. It is also resistant to the transmission of water.

As shown, the back piece 12, inner piece 14 and pocket pieces 48, 60, 52 and 64 are all secured or bound along their respective edges with a binding material 26. The binding material is preferably a binding tape manufactured to the MILL SPEC T 5038 or equivalent. It is positioned over the edges to which it is affixed to have equidistant portions 70 and 72 on opposite sides to form an edge 74. The binding tape 26 is secured by sewing or stitching spaced apart rows 76 and 78 of thread which may be a nylon thread. The double stitching provides for durability and strength. It also prevents water from seeping under the tape and into the area between the outer layer 22 and the insert 24 and between the inner liner 20 and the insert 24. The binding tape 26 prevents the material from threading or fraying. The binding tape 26 also provides a wear surface along its edges which is extremely durable contributing to the durability of the wallet 10.

When assembled, the wallet of the instant invention is particularly flexible or pliable. That is, it bends readily and conforms to the shape of the body to minimize chaffing in use. A person falling on a conventional leather wallet positioned in a hip or back pocket often is severely bruised by the wallet. The wallet 10 of the instant invention is sufficiently flexible and pliable that such injuries are precluded. The fabric also breaths. In other words, air moves readily about and through the immediate surfaces of the outer layer 22 and the other fabric components to avoid the build-up of perspiration. In turn, the occurrence of sores, rashes, blisters and the like which may be suffered by the user of a conventional wallet are minimized.

The wallet 10 of the instant invention has been found to be buoyant. While it is recognized that a person could put items within the wallet of sufficient weight to overcome any buoyancy which is obtained by use of the materials as hereinbefore described, in practical use, it has been found that a quantity of credit cards, currency and even coins can be supported by the buoyant effect of the claimed wallet, for at least a sufficient period of time to permit its recovery by the user. The double stitching 76 and 78, hereinbefore described improves the buoyant affect of the wallet by trapping air in and between the inner liner 20 and insert material 24 and between the insert 24 and the outer layer 22. Also, when the wallet is folded and secured by the latching means, buoyancy is enhanced. Use of the flap 40 with the velcro strips 42 and 44, has been found to be most preferred because the wallet 10 is formed and secured into a compact package with no open transverse edges. This, in turn, contributes to the buoyancy of the wallet and in turn its recoverability if accidentally dropped into water.

The description and illustrations herein set forth are merely illustrative of the principals of the invention. Reference herein to details of the illustrated embodiment is not intended to limit the scope of the claims which themselves recite those features regarded as essential to the invention.

I claim:

1. A wallet comprising:

a back piece substantially rectilinear in shape and having an inner fabric liner and an outer fabric layer sized substantially the same, a fabric inner piece substantially rectilinear in shape and secured along three edges thereof to said back piece to form a currency pocket sized in width and length to receive paper currency, said back piece and said inner piece being foldable about a major axis approximate the lengthwise midpoint of said inner piece, said inner piece being sized in length less than the length of said back piece and secured thereto thereby providing an extension of the back piece forming a flap foldable around a minor axis adjoining the transverse edge of said inner piece said minor axis being generally parallel to said major axis; and latching means secured to said back piece along opposite transverse edges thereof to latch said opposite transverse edges together when said back piece is folded into two adjacent halves about said major axis, said latching means comprising a coacting pair of velcro strips, one being a threaded surface and one being a hook surface, one of which is secured to the inside of said flap and one of which is secured to the outer fabric layer along the transverse edge opposite the transverse edge of said flap.

2. The wallet of claim 1 wherein said inner piece, inner liner and outer layer are made of liquid resistant fabric and further including a material insert between said inner liner and said outer layer; said insert being made of a substantially non-absorptive material resistive to the migration of liquid therethrough.

3. The wallet of claim 2 wherein said outer fabric layer and said fabric inner piece are made of a duck-like material.

4. The wallet of claim 2 wherein said material insert is made of a crinoline material, and wherein said inner fabric liner is made of a nylon-like material.

5. The wallet of claim 2 wherein said material insert is a heavy weight interlon material, said outer fabric layer and said fabric inner piece are made of nylon duck material, and said inner fabric liner is made of a nylon taffeta material.

6. The wallet of claim 1 further including first and second pocket pieces each sized in width substantially the width of said inner piece and in length less than one-half the length of said inner piece, said pocket pieces each being rectilinear in shape and secured to said inner piece along three edges thereof to form pockets with a mouth along the major axis.

7. The wallet of claim 6 further including third and fourth pocket pieces each sized in length substantially to the length of said first and second pocket pieces, respectively, and in width less than the width of said first and second pocket pieces, said third and fourth pocket pieces being shaped to have three edges substantially coterminous with the edges of said first and second pocket pieces, respectively, and secured thereto to form pockets having lengthwise mouths.

8. The wallet of claim 7 wherein said hook surface is secured to said flap and said thread surface is secured to said outer layer.

9. The wallet of claim 8 wherein said inner piece, inner liner and outer layer are made of liquid resistant fabric and further including a material insert between said inner liner and said outer layer; said insert being made of a substantially non-absorptive material resistive to the migration of liquid therethrough.

10. The wallet of claim 9 wherein said inner fabric layer and said material insert are secured to each other along the outer edges thereof with stitched binding tape.

* * * * *

UNITED STATES PATENT OFFICE

CERTIFICATE OF CORRECTION

Patent No. 4,209,048 Dated June 24, 1980

Inventor(s) Michael S. Sandos

It is certified that error appears in the above-identified patent and that said Letters Patent are hereby corrected as shown below:

Col. 3, line 57, change "if" to ---is---.

Signed and Sealed this

Second Day of September 1980

[SEAL]

Attest:

SIDNEY A. DIAMOND

Attesting Officer

Commissioner of Patents and Trademarks